US006883402B2

(12) United States Patent
Cerda

(10) Patent No.: US 6,883,402 B2
(45) Date of Patent: Apr. 26, 2005

(54) RATCHET WRENCH HEAD MEMBER AND SYSTEM

(76) Inventor: Diego Cerda, 629 23rd St., Richmond, CA (US) 94804

( * ) Notice: Subject to any disclaimer, the term of this patent is extended or adjusted under 35 U.S.C. 154(b) by 0 days.

(21) Appl. No.: 10/022,603

(22) Filed: Dec. 17, 2001

(65) Prior Publication Data

US 2002/0088311 A1 Jul. 11, 2002

Related U.S. Application Data

(62) Division of application No. 09/047,010, filed on Mar. 24, 1998, now Pat. No. 6,336,382.
(60) Provisional application No. 60/044,075, filed on Apr. 17, 1997.

(51) Int. Cl.[7] ..... B25B 13/46; B25B 23/16
(52) U.S. Cl. ..... 81/60; 81/177.1; 81/177.2; 81/177.85
(58) Field of Search ..... 81/60, 177.1, 177.2, 81/177.85; 403/361, 300, 345, 365–368

(56) References Cited

U.S. PATENT DOCUMENTS 3,972,252 A * 8/1976 Hunter
5,582,083 A * 12/1996 Baker
5,584,220 A * 12/1996 Darrah et al.
5,782,570 A * 7/1998 Masterson et al.
5,943,924 A * 8/1999 Jarvis
6,324,947 B1 * 12/2001 Jarvis

* cited by examiner

*Primary Examiner*—Debra S. Meislin
(74) *Attorney, Agent, or Firm*—GSS Law Group

(57) ABSTRACT

A wrench head member has an attachment extension which allows the user to attach the wrench head member to a handle. The extension is a collar extending from the side of the wrench head member and having one or two holes extending through the sidewall of a hollowed section. The hollowed section is configured to engage a standard socket extension. Alternately, the wrench head member may have a post which engages a hollow within a handle member. The wrench head member may be a part of a wrench system or kit. The wrench head member has an attachment extension which allows the user to attach the wrench head member to a handle, preferably a socket extension. The attachment between the handle and the wrench head member is a male/female connection. Preferably, the wrench head is the female member having a collar extending from the side of the wrench head and having a pair of holes extending through the sidewall of the collar for the locking ball and release button on a socket extension. In an alternate embodiment, the wrench head member is the male member and the socket extension may be a modified version which provides a hollowed channel for a post extending from the wrench head member.

17 Claims, 5 Drawing Sheets

RATCHET WRENCH HEAD MEMBER AND SYSTEM

CROSS REFERENCE TO OTHER APPLICATIONS

This is a divisional application of U.S. application Ser. No. 09/047,010, filed Mar. 24, 1998, now U.S. Pat. No. 6,336,382 entitled: Ratchet Wrench Head Member and System, which further claims the benefit of the priority date of provisional patent application Ser. No. 60/044,075 filed on Apr. 17, 1997.

FIELD OF THE INVENTION

The present invention relates generally to an improved wrench head member, the wrench head member may be a part of a wrench system which is lighter and more compact than previous systems.

BACKGROUND OF THE INVENTION

Wrenches of assorted sizes and shapes have existed for decades. Most tool sets are bulky and of significant weight. A standard tool set has multiple handles, socket extensions, sockets, etc. Carrying or storing a full set of tools may be difficult due to its bulk and significant weight. In order to reduce the weight, the tool industry offers ratchet systems with a drive which fits several different socket extension. This allows a single handle to be used for several different configurations. However, there are still many bulky pieces which are redundant for any particular configuration.

To address the problems listed above, universal wrenches have been designed which fit multiple size bolts. There are several different variations of this type of device. One version has a rotatable head which rotates in relation to the handle to engage the bolt between the head and the handle as the user begins to twist the wrench. Another version has a sliding member which adjusts to the diameter of the bolt. Typically, these wrenches are more difficult to use, especially in situations where a 360° area surrounding the bolt is not free of interfering objects.

Another tool is a device sold by Mac Tools listed as part number W3R (Ratchet Head Only) and W30 H (Attachment Handle). The W3R device is a ratchet head which has a hollow round extension for a cylindrical handle. The extension has an opening for a locking button. The locking button on the handle is depressed with a screwdriver or other rigid device as the handle is inserted into hollow. When the handle is inserted and properly orientated, the locking button pops up into the opening in the extension. To remove the handle, a screw driver or other small, relatively rigid member is used to force the locking ball down as the handle is pulled out of the hollow. In order to maintain the locking ball within the opening, the movement of the ball must be extremely stiff, otherwise the handle would be prone to rotation within the hollow. Further, this device still requires the same number and variety of pieces and, therefore, would have the same problems with bulk and weight.

SUMMARY OF THE INVENTION

One embodiment of the present invention takes the form of a wrench head member having an attachment extension which allows the user to attach the wrench head member to a handle. In a preferred embodiment, the extension is a collar extending from the side of the wrench head member and having one or two holes extending through the sidewall of a hollowed section. The hollowed section is configured to engage a standard socket extension. Alternately, the wrench head member may have a post which engages a hollow within a handle member.

The wrench head member may also form part of a multi-piece, light-weight wrench system which provides a stable engagement between the assembled pieces of the wrench. The wrench is formed of two pieces: the wrench head member and a handle member. The wrench head member has an attachment extension which allows the user to attach the wrench head member to the handle. Although any elongate member may be used, the handle is preferably a socket extension. The attachment between the handle and the wrench head member is a male/female connection. Preferably, the wrench head is the female member having a collar extending from the side of the wrench head and having a pair of holes extending through the sidewall of the collar for the locking ball and release button on a socket extension. However, if preferred, the wrench head member may be the male member and the socket extension may be a modified version which provides a hollowed channel for a post extending from the wrench head member. Other variations and advantages of the invention will no doubt occur to those skilled in the art upon reading and understanding the following detailed description along with the accompanying drawings.

DETAILED DESCRIPTION OF THE INVENTION

Figure 1:
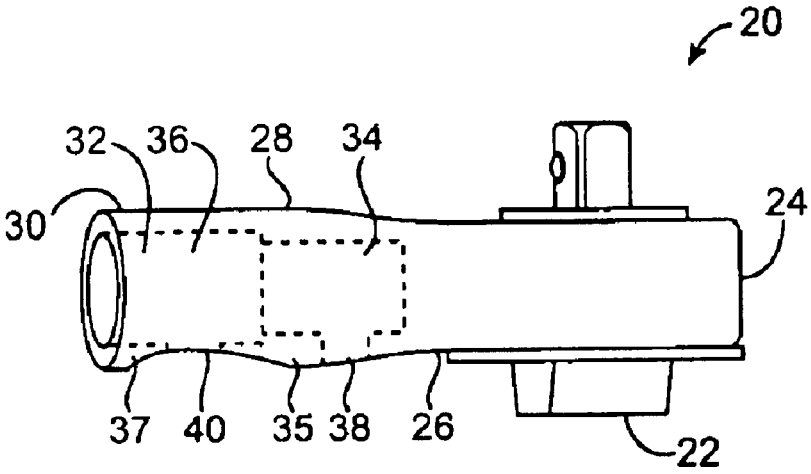
FIG. 1 is a side view of a quick-release ratchet wrench head member embodiment.
Figure 2:
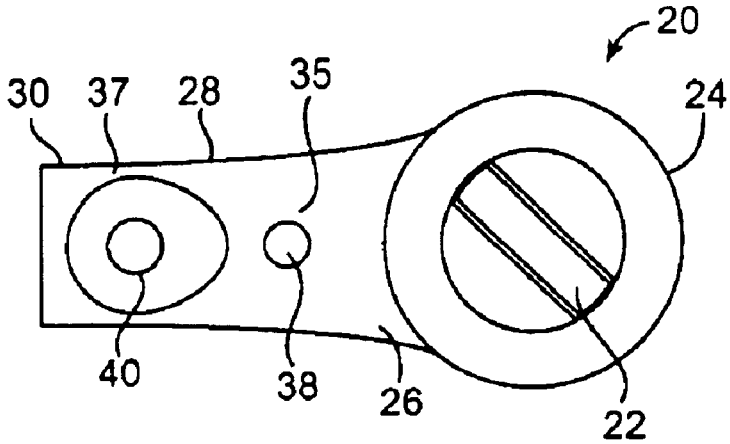
FIG. 2 is a top view of the quick-release ratchet wrench head member embodiment.
Figure 3:
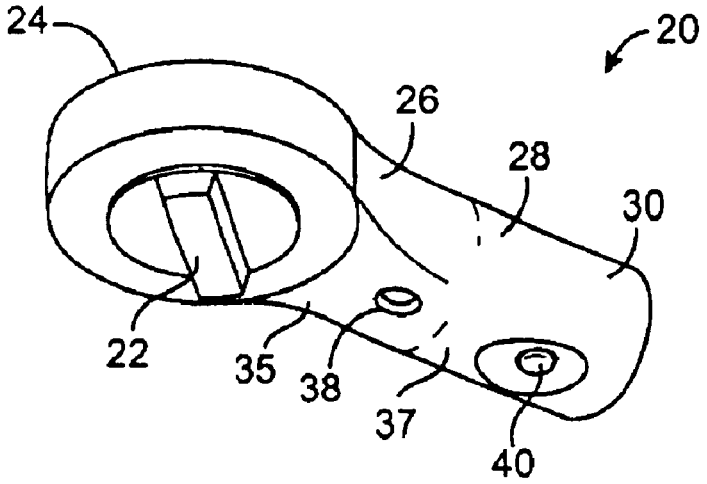
FIG. 3 is a top perspective view of the quick-release ratchet wrench head member embodiment.

FIGS. 1, 2, and 3 are side, top, and perspective views, respectively, of a quick-release ratchet wrench head member 20. In this embodiment, the wrench head member 20 has a quick-release button 22 which actuates the locking ball 54 on the drive 52 of a socket extension 50 (see FIGS. 4 and 5A–5D). Extension collar 28 extends from the base 26 of the wrench head 24. The lower portion 30 of the collar 28 is hollow and is configured to engage a socket extension 50.

There are two sections of the hollowed portion 32: a drive hollow section 34 and a shaft hollow section 36. Closest to the wrench head 24 is the drive hollow 34, a square section which is configured to engage the drive 52 of the socket extension 50. Connecting to the drive hollow 34 is the shaft hollow 36 which is preferably round and configured to engage the shaft 58 of the socket extension 50. Optionally, the drive hollow 34 may be formed in alternate configurations such as hexagonal, star-shaped, etc. The only requirement is that the connection between the drive 52 and the drive hollow 34 inhibited turning within the collar 28.

A locking hole 38 is located through the sidewall 35 of the drive hollow 34 and is configured to engage the locking ball 54 on the socket extension drive 52. A release hole 40 is located through the sidewall 37 of the shaft hollow 36. The release hole 40 is for use with quick-release socket extensions 50 which have a release button 56 on the shaft 58 which, when depressed, allows the locking ball 54 on the drive 52 of the socket extension 50 to depress.

In the present embodiment, the release hole 40 is a wide shallow hole to allow easy access for a user's thumb or finger. In alternate embodiments, the sides of release hole 40 may have different slopes or shapes to fit particular uses or tools.

Figure 4:
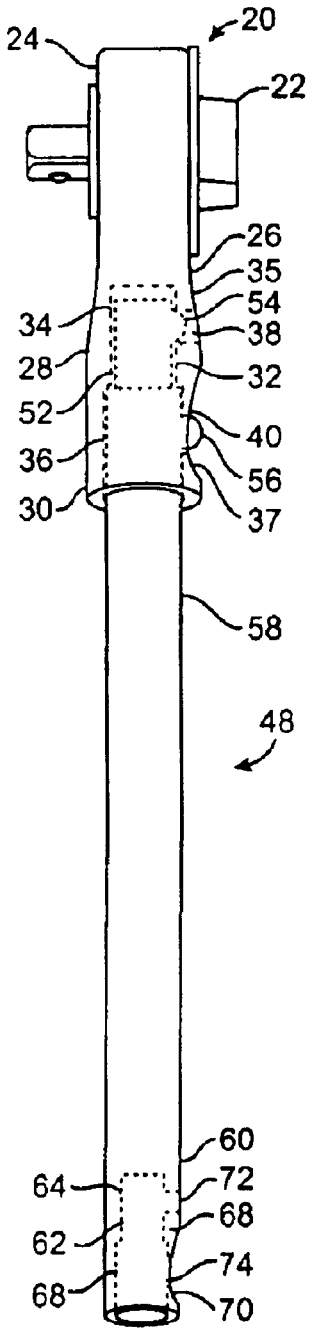
FIG. 4 is a side view of the quick-release ratchet wrench head member attached to a modified socket extension.
Figure 5A:
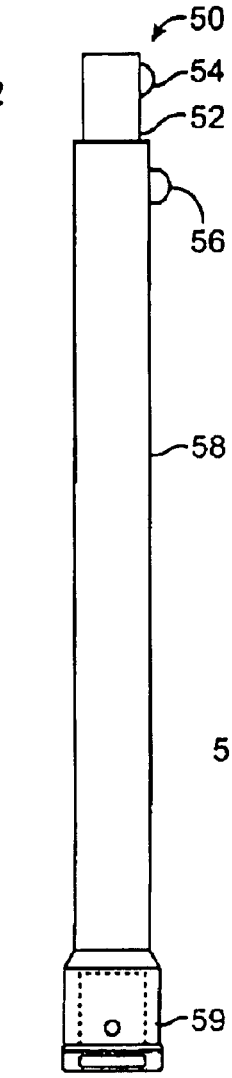
(PRIOR ART) FIG. 5A
FIGS. 5A–D are side views of assorted socket extensions.
Figure 5B:
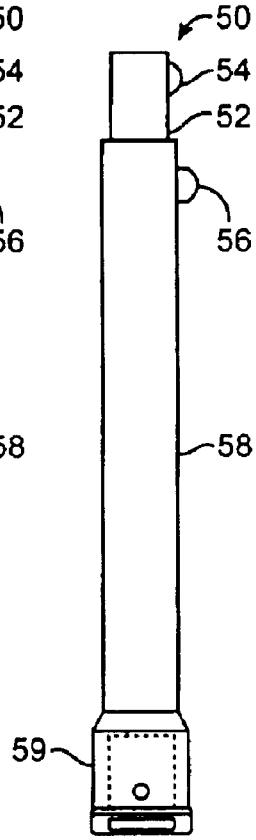
(PRIOR ART) FIG. 5B
Figure 5C:
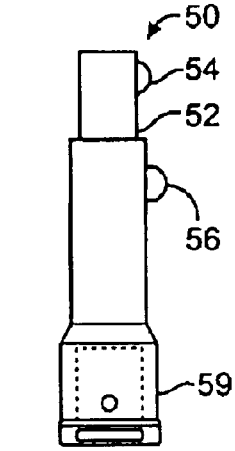
(PRIOR ART) FIG. 5C
Figure 5D:
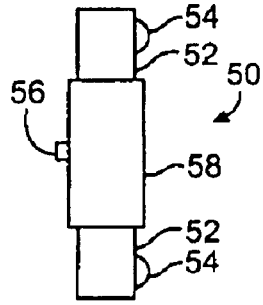
(PRIOR ART) FIG. 5D

FIG. 4 is a side view of the first ratchet wrench head member 20 attached to a modified quick-release socket extension 48. The drive end 52 of the socket extension 48 is received within the hollowed portion 32 of the collar 28. The collar 28 of the wrench head member 20 provides a stable engagement between the socket extension 48 and the wrench head member 20. The locking ball 54 is locked within the locking hole 72 and prevents the socket extension 48 from pulling out of the wrench head member 20 unless the release button is depressed. The engagement between the drive 52 and the drive hollow 34 prevent the socket extension 48 from rotation within the collar 28. The overall engagement between the hollowed portion 32 and the drive 52 and shaft 58 of the socket extension 48 transfer the torque forces from the socket extension 48 to the wrench head 24. Currently, the collar 28 is between 1.0 and 4.0 inches in length, preferably between 1.5 and 3.0 inches, most prefered between 1.5 and 2.0 inches. However, alternate embodiments may have longer or shorter collars 28 to prove the amount of stabilty necessary.

The locking ball 54 on the drive 52 is released by pressing a finger or thumb through the release hole 40 to depress the release button 56 on the shaft 58 of the socket extension 48. This embodiment of socket extension 48 is modified to fit a second socket extension 50 into its base 60. The base 60 of the socket extension 48 is a hollow 62 having two sections: a drive hollow 64 and a shaft hollow 68. Once again, a locking hole 72 passes through the sidewall 66 of the drive hollow 64 and a release hole 74 passes through the sidewall 70 of the shaft hollow 68. If desired, a user could place the drive 52 of a second socket extension 48 into the hollow 62 to form a longer handle, thereby increasing the lever arm to increase the amount of rotational force applied to the wrench head 24 without increasing the force exerted by the user.

FIGS. 5A–D are side views of assorted prior art socket extensions 50 which may be used with the present invention. The set of socket extensions 50 shown are of the release style having a release button 56 which a user presses to release the locking ball 54 on the drive 52. However, any type of socket extension 50 may be used with the present invention.

Figure 6:
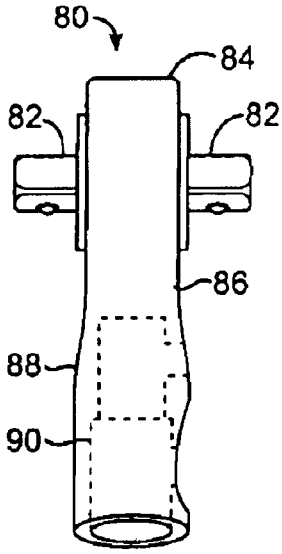
FIG. 6 is a side view of a wrench head member having two opposing drives.
Figure 7A:
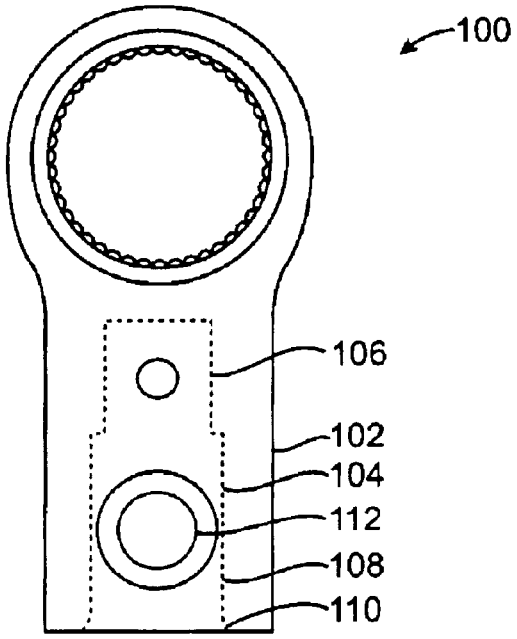
FIGS. 7A and B are front and side views of a closed-end, box ratchet wrench head member embodiment.
Figure 7B:
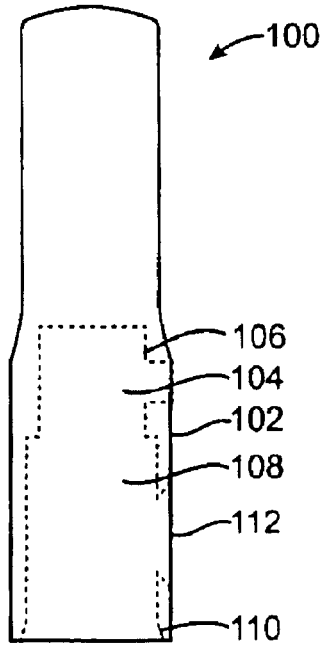

FIG. 6 is a side view of a wrench head member 80 having two opposing drives 82. This style wrench head member 80 has two drives 82 that may be of the same or differing sizes. At the base 86 of the wrench head 84 is a collar 88 having a hollowed portion 90 configured to hold a socket extension 50 similar to the embodiment shown in FIGS. 1–3. FIGS. 7A and B are front and side views of a closed-end, box ratchet wrench head member 100. The box may have any number of points to form the opening and may be fitted with a socket drive if desired. At the base of the wrench head member 100 is a collar 102 having a hollow 104 with two sections: a drive hollow 106 and a shaft hollow 108. In this configuration, the end of the shaft hollow 108 is tapered. The tapered section 110 guides the socket extension 50 into the hollowed portion 104 to facilitate easy insertion of the socket extension 50. The release button hole 112 has a steeper sidewall angle and has a circular shape for ease of manufacturing.

Figure 8A:
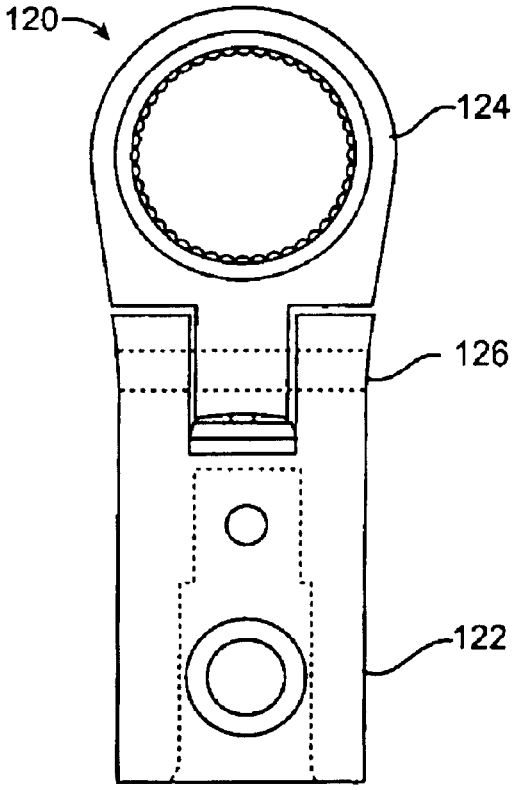
FIGS. 8A and B are front and side views of a flexible head, closed-end, box ratchet wrench head member embodiment.
Figure 8B:
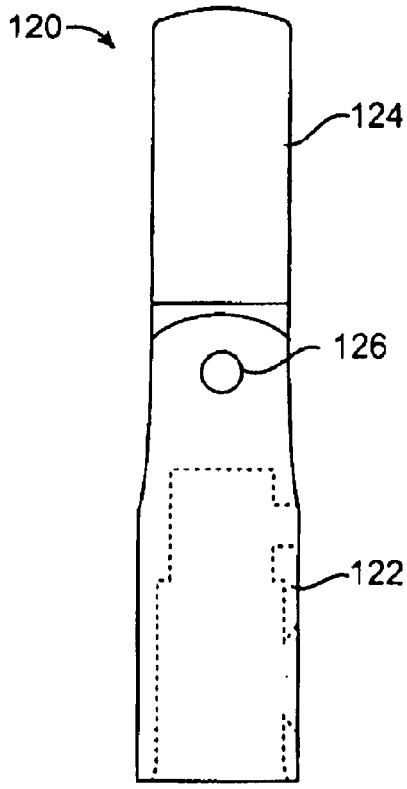

FIGS. 8A and B are front and side views of a flexible head, closed-end, box ratchet wrench head member 120 which is a variation of the embodiment shown in FIGS. 7A and B, but with the collar 122 connected to the wrench head 124 by a pivot 126 which pivots around a pivot point. The pivot 126 allows the user to choose the angle between the wrench head 124 and the collar 122, thereby choosing the angle between the wrench head 124 and the handle.

Figure 9A:
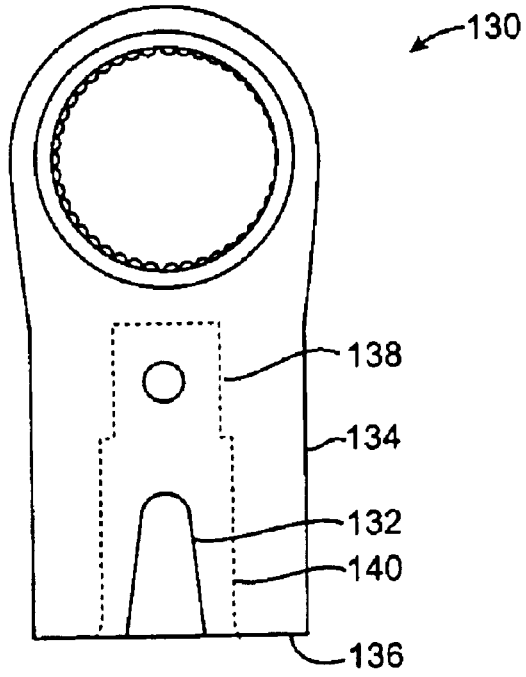
FIGS. 9A and B are front and side views of an alternate closed-end, box ratchet wrench head member embodiment.
Figure 9B:
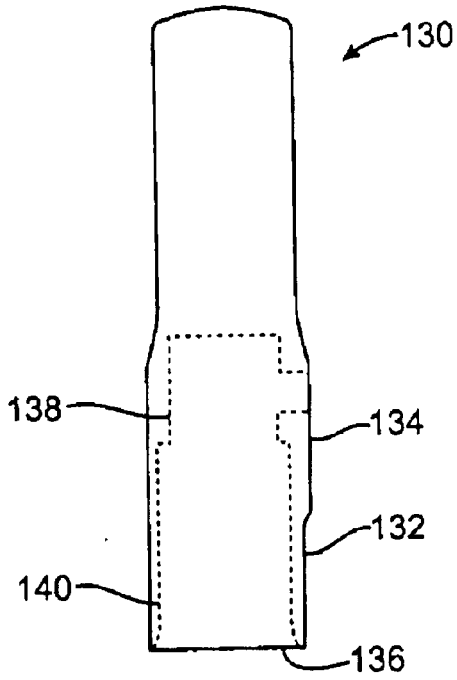

FIGS. 9A and B are front and side views of an alternate closed-end, box ratchet wrench head member 130 which is a variation of the embodiment previously described and shown in FIGS. 7A and B. In this case, the release button opening is a slot 132 extending from the end 136 of the collar 134. In the design shown, the slot 132 is tapered to guide the socket extension 50 into place within the hollowed portions 138, 140. The slot also assists the user in aligning the square drive 52 of the socket extension 50 with the square drive hollow 138. In alternate embodiments, the slot 132 may be a different shape for utilitarian or design purposes.

Figure 10A:
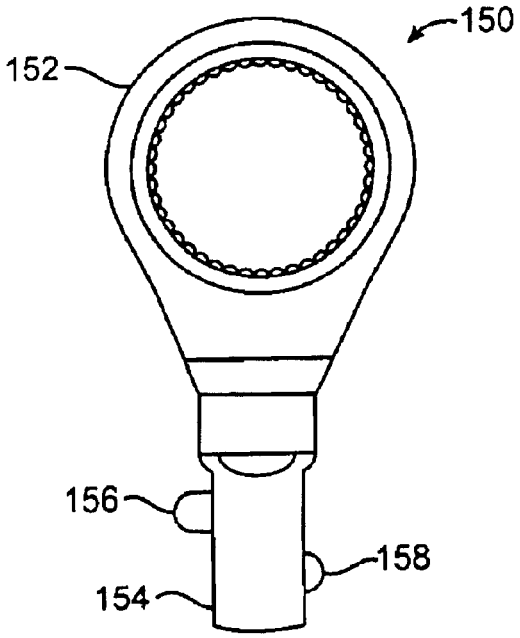
FIGS. 10A and B are front and side views of a closed-end, box ratchet wrench embodiment.
Figure 10B:
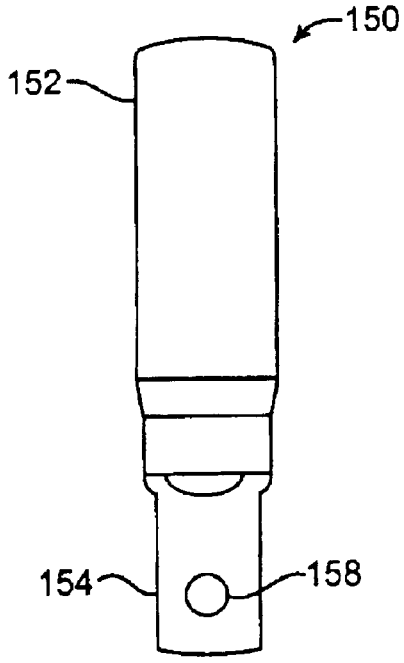

FIGS. 10A and B are front and side views of a closed-end, box ratchet wrench head member 150. The configuration shown is used with an alternate version of the socket extension, a version of which is shown as the base 60 of the socket extension seen in FIG. 4. In this version, the wrench head 152 is attached to a post 154 which is configured to fit within a hollowed end 62 of a socket extension 50. The hollowed portion of the socket extension would have openings to accommodate the locking ball 156 and the release button 158.

Figure 11A:
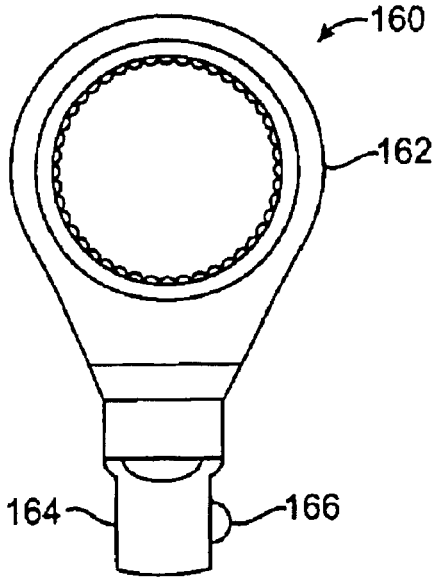
FIGS. 11A and B are front and side views of a closed-end, box ratchet wrench head member embodiment.
Figure 11B:
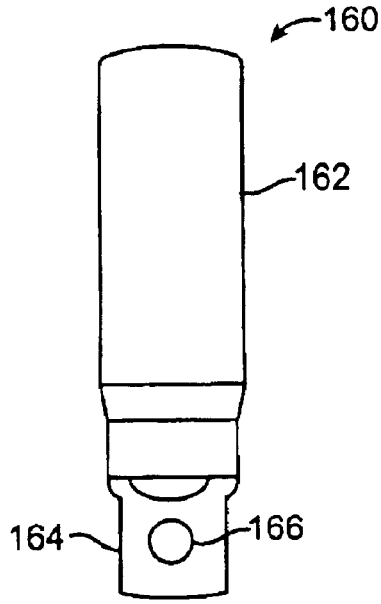

FIGS. 11A and B are front and side views of an closed-end, box ratchet wrench head member 160 which is a variation of the embodiment shown in FIGS. 10A and B. The wrench head 162 is connected to a post 164 which has a locking ball 166 located thereon. The socket extension 50 which corresponds to this embodiment 160 has an opening configured to engage the post 164 and locking ball 166.

Figure 12A:
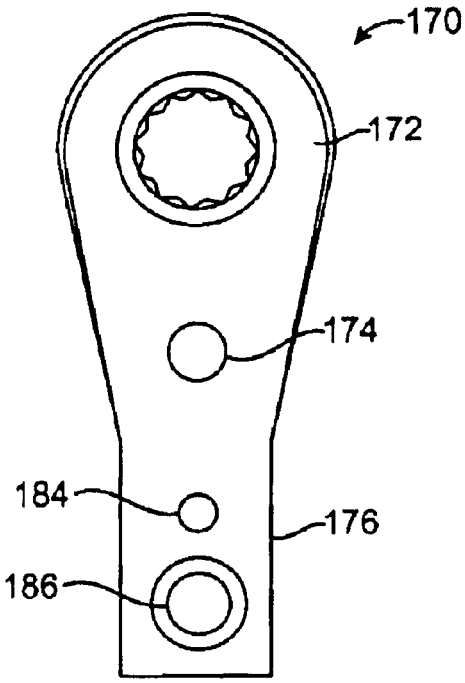
FIGS. 12A and B are front and side views of a quick-release, closed-end, box ratchet wrench head member embodiment.
Figure 12B:
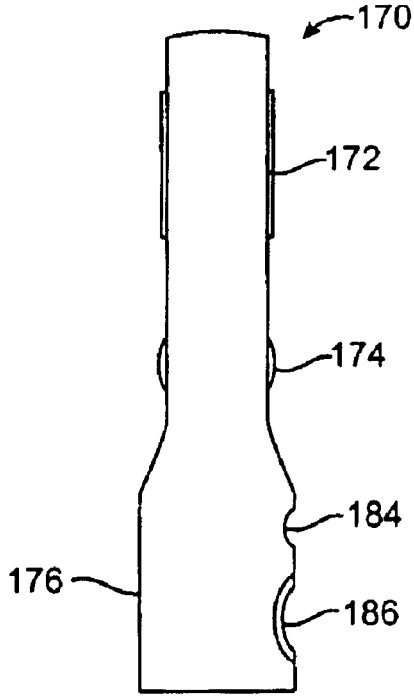

FIGS. 12A and B are front and side views of a quick-release, closed-end, box ratchet wrench head member 170. In this embodiment 170, the quick-release button 174 is located below the wrench head 172 and above the attaching collar 176. The attaching collar 176 has two holes: a locking ball opening 184 and a release button opening 186. These two openings 184, 186 lead into a hollow similar to those seen in other embodiments described herein.

The present invention is preferably forged steel, however alternate materials may also be used such as aluminum, and plastic with or without reinforcing, and alternate fabrication processes may be used such as casting, molding, machining, etc. depending on the strength and weight requirements.

The present invention is currently envisioned as a replacement for the traditional wrenches handle assemblies in a standard wrench set and may be in standard sizes or dimensions such as ¼", ⅜", ½", and ¾". However, the dimensions may increased or decreased or otherwise varied for alternate applications.

Although the examples given include many specificities, they are intended as illustrative of only one possible embodiment of the invention. Other embodiments and modifications will, no doubt, occur to those skilled in the art. For example, features have been listed with particular configurations. Any one or more of the features may be added to or combined with any of the other embodiments or other standard tools to create alternate combinations and embodiments. Thus, the examples given should only be interpreted as illustrations of some of the preferred embodiments of the invention, and the full scope of the invention should be determined by the appended claims and their legal equivalents.

What is claimed is:

1. In combination:

A wrench head member having a wrench head and a shaft extending therefrom, said shaft having a first end and a second end, said first end of said shaft being coupled to said wrench head, a drive section extending from said second end, a locking member extending from said drive section, and a release button; wherein said shaft is approximately circular in cross section, and said drive section is approximately square in cross section and; and an extension member having an extension collar, said extension collar having a hollow portion that includes a drive hollow portion configured for accepting and engaging said drive section of said shaft of said wrench head inserted therein, said drive hollow portion of said extension is approximately square in cross section for accepting and engaging said drive section of said shaft of said wrench head inserted therein, a first opening within a sidewall of said hollow portion of said extension collar, said first opening being located to engage said locking member of said shaft of said wrench head member, a shaft hollow section configured for accepting and engaging a portion of said shaft of said wrench head inserted therein, said shaft hollow section of said extension is approximately circular in cross section for accepting and engaging a portion of said shaft of said wrench head inserted therein, and a second opening within said sidewall of said hollow portion of said extension collar, said second opening being located to provide access to said release button;

whereby said wrench head member is operated using said extension member as a handle.

2. The combination of claim 1 wherein said release button is located on a portion of said shaft of said wrench head.

3. A wrench head member configured to use a socket wrench extension as a wrench handle, the socket wrench extension having a shaft section, a drive section extending from the shaft section, a locking member extending from the drive section thereof and a release button that, when actuated, releases the locking member, said wrench head member comprising:

a wrench head having a drive member, an extension collar, distinct from said drive member, extending from said wrench head, said extension collar having a hollow portion that includes a drive hollow portion configured for accepting and engaging the drive section of the socket wrench extension inserted therein and a shaft hollow section configured for accepting and engaging a portion of the shaft section of the socket wrench extension inserted therein, said drive hollow portion having an approximately square cross section and said shaft hollow section having an approximately circular cross section, said extension collar having a first opening within a sidewall of said drive hollow portion and a second opening within a sidewall of said shaft hollow portion, said first opening being located to engage the locking member of the socket wrench extension and said second opening being located to provide access to the release button of the socket wrench extension, whereby said wrench head member is operated using the socket wrench extension as a wrench handle by inserting the socket wrench extension into said hollow portion of said extension collar such that the drive section of the socket wrench extension engages said drive hollow portion of said extension collar and the shaft section of the socket wrench extension engages said shaft hollow portion of said extension collar.

4. The wrench head member of claim 3 wherein said second opening is a slot.

5. The wrench head member of claim 3 wherein said drive member of said wrench head further comprises a ratchet drive mechanism.

6. The wrench head member of claim 3 wherein said drive member of said wrench head comprises a socket drive for engaging a wrench socket.

7. In combination:

a wrench head member configured to use a socket wrench extension as a handle, said wrench head member having a shaft section, a drive section extending from said shaft section, a locking member extending from the drive section thereof and a release button that, when actuated, releases the locking member, a socket wrench extension having an extension collar extending from a first end of said socket extension, said extension collar having a hollow portion that includes a drive hollow portion configured for accepting and engaging the drive section of the wrench head extension inserted therein and a shaft hollow section configured for accepting and engaging a portion of the shaft section of the wrench head inserted therein, said socket wrench extension having a first opening within a sidewall of said drive hollow portion and a second opening within a sidewall of said shaft hollow portion, said first opening being located to engage the locking member of the wrench head member and said second opening being located to provide access to the release button of the wrench head member, whereby said wrench head member is operated using the socket wrench extension as a wrench handle by inserting the shaft section and a drive section of the wrench head member into said hollow portion of said extension collar of said socket wrench extension such that the drive section of the wrench head member engages said drive hollow portion of said extension collar and said shaft section of the wrench head member engages said shaft hollow portion of said extension collar.

8. The combination of claim 7 wherein said socket wrench extension further includes a second extension collar extending from a second end of said socket extension, said second extension collar having a hollow portion that includes a drive hollow portion configured for accepting and engaging said drive section of said wrench head inserted therein and a shaft hollow section configured for accepting and engaging a portion of the shaft section of the wrench head inserted therein.

9. The combination of claim 7 wherein said drive hollow portion is approximately square in cross section and said shaft hollow portion is approximately circular in cross section.

10. The combination of claim 7 wherein said drive section is approximately square in cross section and said shaft section is approximately circular in cross section.

11. The combination of claim 7 wherein said second opening is a slot.

12. The combination of claim 7 wherein said drive section of said wrench head further comprises a ratchet drive mechanism.

13. The combination of claim 7 wherein said drive section of said wrench head comprises a socket drive for engaging a wrench socket.

14. A handle for use with a wrench system having a plurality of mating pieces having a locking member and a release button, the handle comprising:

a shaft portion having a first end and a second end, a first connector portion extending from said first end of said shaft portion, said first connector portion being a hollow collar having a generally square drive engaging portion and a generally round shaft engaging portion, a first opening in a sidewall of said hollow collar for engaging the locking member and a second opening in said sidewall of said hollow collar for providing access to the release button, and a second connector extending from said second end of said shaft portion.

15. The handle of claim 14 wherein said second connector is a generally square drive section having a locking member extending therefrom and a release button extending from said shall portion proximate said second end of said shaft.

16. The handle of claim 15 wherein said handle is also configured to be used as an extension member for the wrench system.

17. The handle of claim 15 further comprising a plurality of mating pieces, said plurality of mating pieces including a wrench head member having a post with the locking member and the release button.

* * * * *